US010498053B1

(12) United States Patent
Sawzin

(10) Patent No.: US 10,498,053 B1
(45) Date of Patent: Dec. 3, 2019

(54) ELECTRICAL WIRING JUNCTION BOX

(71) Applicant: Stephen Sawzin, Wilmington, OH (US)

(72) Inventor: Stephen Sawzin, Wilmington, OH (US)

( * ) Notice: Subject to any disclaimer, the term of this patent is extended or adjusted under 35 U.S.C. 154(b) by 0 days.

(21) Appl. No.: 16/278,812

(22) Filed: Feb. 19, 2019

(51) Int. Cl.
*H01R 9/22* (2006.01)
*H01R 9/24* (2006.01)
*H01R 4/36* (2006.01)
*H01R 4/30* (2006.01)

(52) U.S. Cl.
CPC ..... *H01R 9/24* (2013.01); *H01R 4/305* (2013.01); *H01R 4/36* (2013.01)

(58) Field of Classification Search
CPC ..... H01R 9/24; H01R 4/36; H01R 4/305
USPC ..... 439/709
See application file for complete search history.

(56) References Cited

U.S. PATENT DOCUMENTS 2,882,513 A * 4/1959 Olashaw ..... H01R 9/22 439/682
3,133,779 A * 5/1964 Stanback ..... H01R 4/36 439/798
3,638,173 A * 1/1972 Middendorf ..... H01R 4/36 439/814
3,725,851 A * 4/1973 Linn ..... H01R 4/36 439/798
3,732,530 A * 5/1973 Linn ..... H01R 4/36 439/798
4,050,770 A 9/1977 Rigo
4,148,136 A * 4/1979 Waddington ..... H01R 4/36 29/510
4,456,326 A * 6/1984 Sauber ..... H01R 4/66 439/540.1
5,005,104 A * 4/1991 Grunert ..... H01H 71/08 335/202
5,032,092 A 7/1991 Linn
5,199,905 A * 4/1993 Fillinger ..... H01R 4/34 439/723
D342,937 S 1/1994 Angel, Jr. et al.
5,285,011 A 2/1994 Shimochi
5,471,012 A * 11/1995 Opel ..... H02G 3/16 174/53
5,531,617 A * 7/1996 Marks ..... H01R 9/24 439/723
5,571,031 A * 11/1996 Robinson ..... G01R 11/04 439/508
5,662,499 A * 9/1997 Strack ..... H01R 9/2483 439/709

(Continued)

*Primary Examiner* — Abdullah A Riyami
*Assistant Examiner* — Vladimir Imas
(74) *Attorney, Agent, or Firm* — Kyle A. Fletcher, Esq.

(57) ABSTRACT

The electrical wiring junction box comprises an insulated base, a plurality of wiring apertures, a plurality of bar apertures, a plurality of conductive bars, and a plurality of clamp screws. The insulated base may comprise a plurality of tiers at different vertical heights. Each of the plurality of tiers may be associated with an electrical attribute. A first conductor of a first circuit may be electrically coupled to a second conductor of a second circuit by connecting the conductors to the same bar at one tier. An individual conductor may be connected to the individual bar by placing the stripped end of the individual conductor into an individual wiring aperture selected from the plurality of wiring apertures and then tightening an individual clamp screw at the individual wiring aperture where the individual conductor is inserted.

19 Claims, 4 Drawing Sheets

(56) References Cited

U.S. PATENT DOCUMENTS 5,785,551 A 7/1998 Libby
5,931,708 A * 8/1999 Annas ..... H01R 4/36 439/724
6,154,947 A * 12/2000 Koebbe ..... B29C 33/0033 264/301
6,176,747 B1 * 1/2001 Rowe ..... H01R 9/2491 439/701
6,186,838 B1 2/2001 Foster
6,193,566 B1 * 2/2001 Isobe ..... H01R 4/305 439/801
6,325,675 B1 * 12/2001 Harmeyer ..... H01R 13/5213 439/709
6,497,592 B1 * 12/2002 Beadle ..... H01R 9/2425 439/718
6,527,598 B1 * 3/2003 Opel ..... H01R 9/2408 439/709
6,579,131 B1 * 6/2003 Ashcraft ..... H01R 4/36 439/798
6,612,879 B1 * 9/2003 Zahnen ..... H01R 4/36 439/798
6,664,469 B1 * 12/2003 Sweeney ..... H01R 9/2458 174/135
6,786,766 B1 9/2004 Chopra
6,854,996 B2 * 2/2005 Yaworski ..... H01R 4/36 174/71 B
7,011,551 B2 * 3/2006 Johansen ..... H01R 9/2641 439/709
7,090,526 B2 * 8/2006 Monte ..... H01R 13/743 439/357
7,311,564 B2 * 12/2007 Zahnen ..... H01R 4/36 439/798
7,320,626 B2 * 1/2008 Drane ..... H01R 4/307 439/798
7,364,476 B2 * 4/2008 Mueller ..... H01R 4/36 439/709
7,618,299 B2 * 11/2009 Ferretti ..... H01F 27/04 439/798
7,753,739 B2 * 7/2010 Bentler ..... H01R 9/2491 439/532
7,767,905 B2 * 8/2010 Meyer ..... H02G 3/123 174/135
7,914,300 B2 3/2011 Akahori
7,942,679 B1 * 5/2011 Gretz ..... H01R 4/36 439/108
7,942,706 B1 * 5/2011 McSweyn ..... H01R 9/2483 439/709
8,206,186 B2 * 6/2012 Kisic ..... G01R 1/0408 439/482
8,369,679 B2 * 2/2013 Wakileh ..... G02B 6/4477 174/78
8,425,264 B2 * 4/2013 Michell ..... H01R 4/42 439/789
8,602,829 B2 * 12/2013 Kosyanchuk ..... H01R 4/363 439/813
8,784,142 B2 * 7/2014 Golen ..... H01R 9/24 439/798
9,004,956 B2 * 4/2015 Wu ..... H01R 4/34 439/709
9,437,978 B2 * 9/2016 Green ..... H01R 13/652
10,236,600 B2 * 3/2019 Berg ..... H01R 9/24
2005/0233649 A1 * 10/2005 Siracki ..... H01R 4/305 439/721

* cited by examiner

ELECTRICAL WIRING JUNCTION BOX

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of electrical wiring, more specifically, an electrical wiring junction box.

SUMMARY OF INVENTION

The electrical wiring junction box comprises an insulated base, a plurality of wiring apertures, a plurality of bar apertures, a plurality of conductive bars, and a plurality of clamp screws. The insulated base may comprise a plurality of tiers at different vertical heights. Each of the plurality of tiers may be associated with an electrical attribute. A first conductor of a first circuit may be electrically coupled to a second conductor of a second circuit by connecting the conductors to the same bar at one tier. An individual conductor may be connected to the individual bar by placing the stripped end of the individual conductor into an individual wiring aperture selected from the plurality of wiring apertures and then tightening an individual clamp screw at the individual wiring aperture where the individual conductor is inserted.

An object of the invention is to couple a conductor or one circuit to a conductor or at least one other circuit.

Another object of the invention is to provide multiple tiers to make the coupling points easier to access.

A further object of the invention is to couple an individual conductor by using a clamp screw.

Yet another object of the invention is to provide an entry point for a conductor at the front face of a tier and access to clamp screws at the top face of the tier.

These together with additional objects, features and advantages of the electrical wiring junction box will be readily apparent to those of ordinary skill in the art upon reading the following detailed description of the presently preferred, but nonetheless illustrative, embodiments when taken in conjunction with the accompanying drawings.

In this respect, before explaining the current embodiments of the electrical wiring junction box in detail, it is to be understood that the electrical wiring junction box is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the electrical wiring junction box.

It is therefore important that the claims be regarded as including such equivalent construction insofar as they do not depart from the spirit and scope of the electrical wiring junction box. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
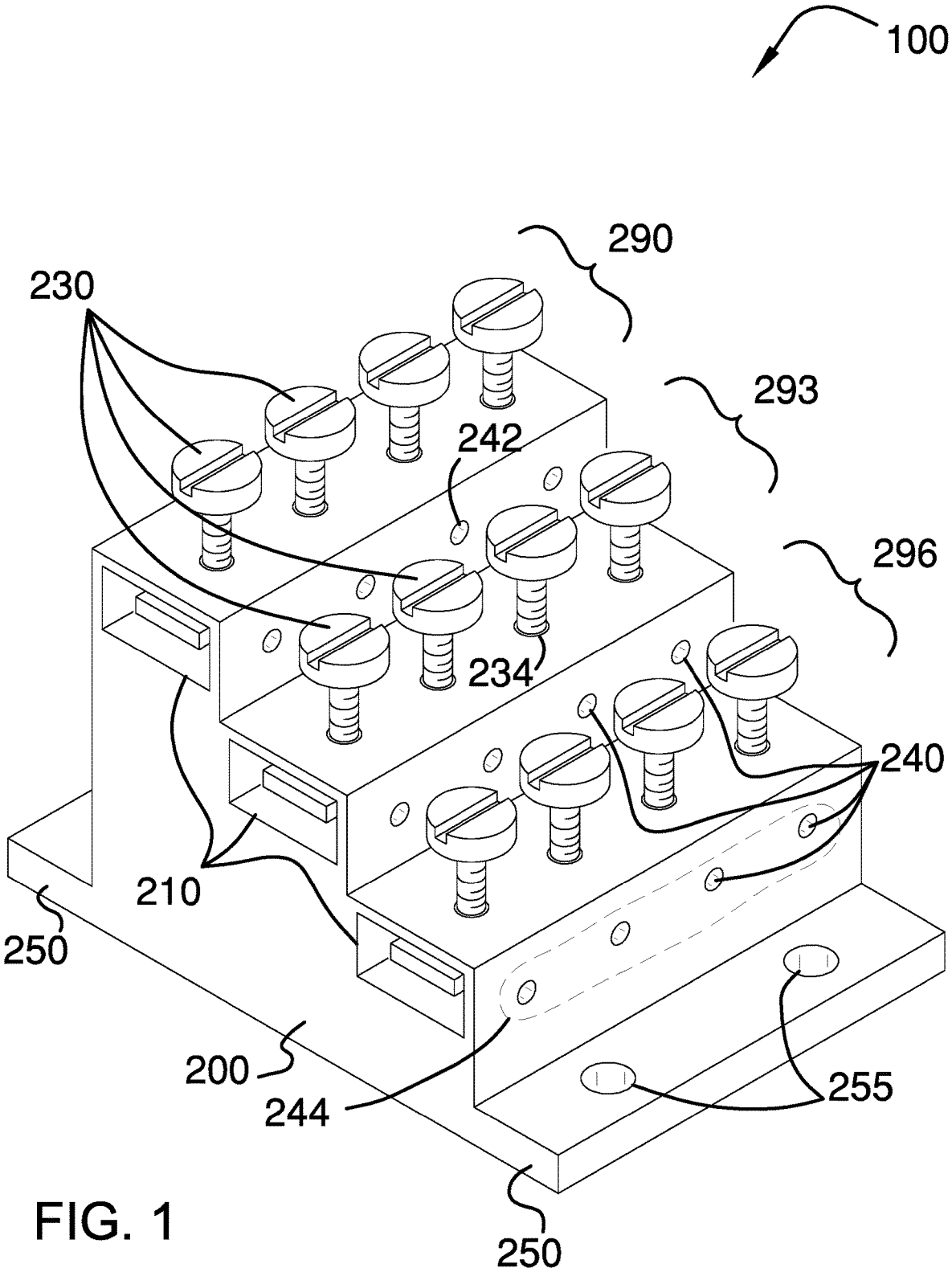
FIG. 1 is a perspective view of an embodiment of the disclosure.
Figure 2:
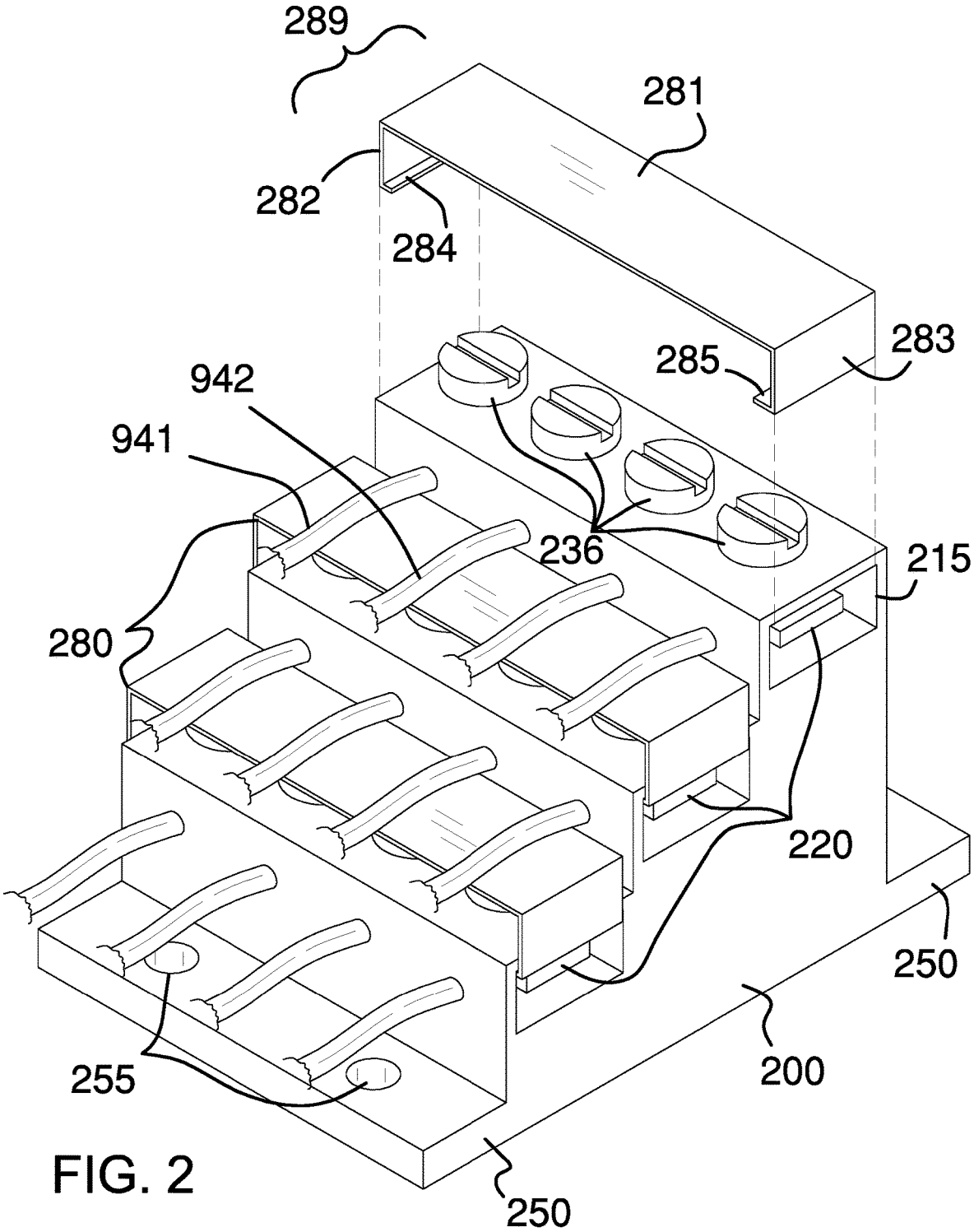
FIG. 2 is an in-use view of an embodiment of the disclosure.
Figure 3:
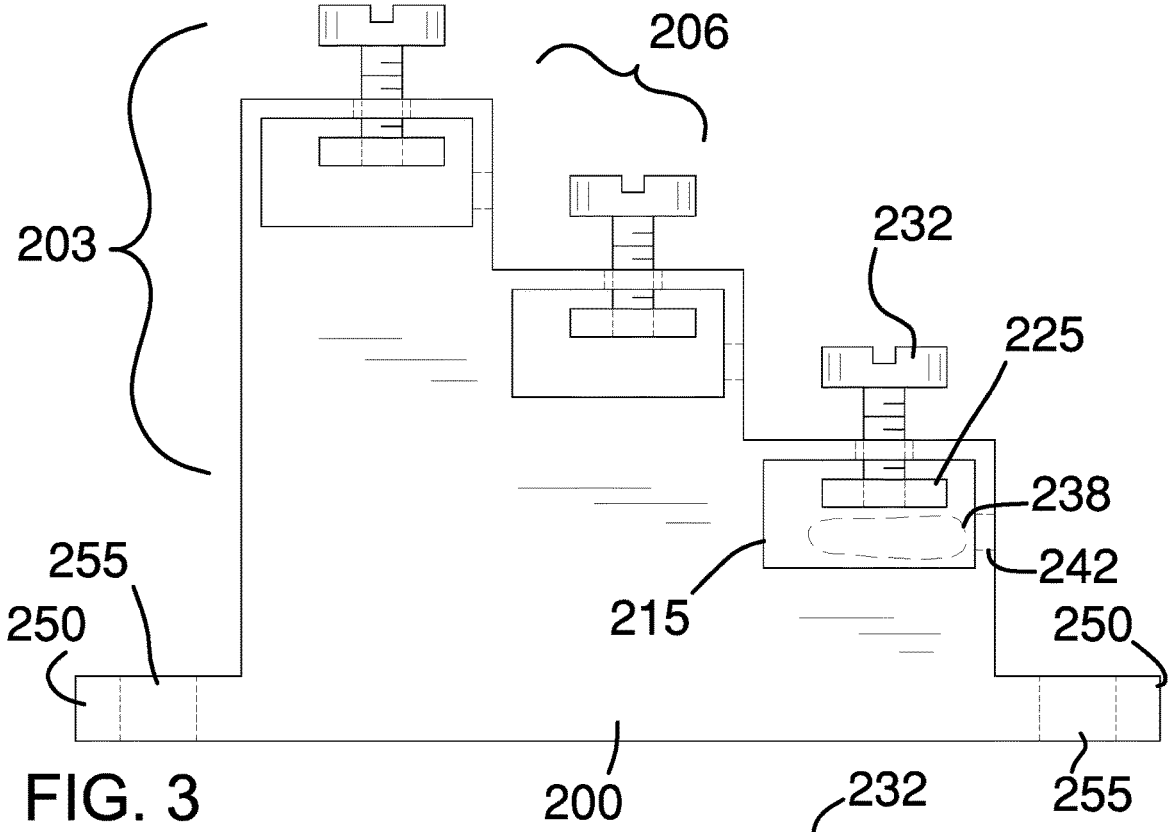
FIG. 3 is a front view of an embodiment of the disclosure.
Figure 4:
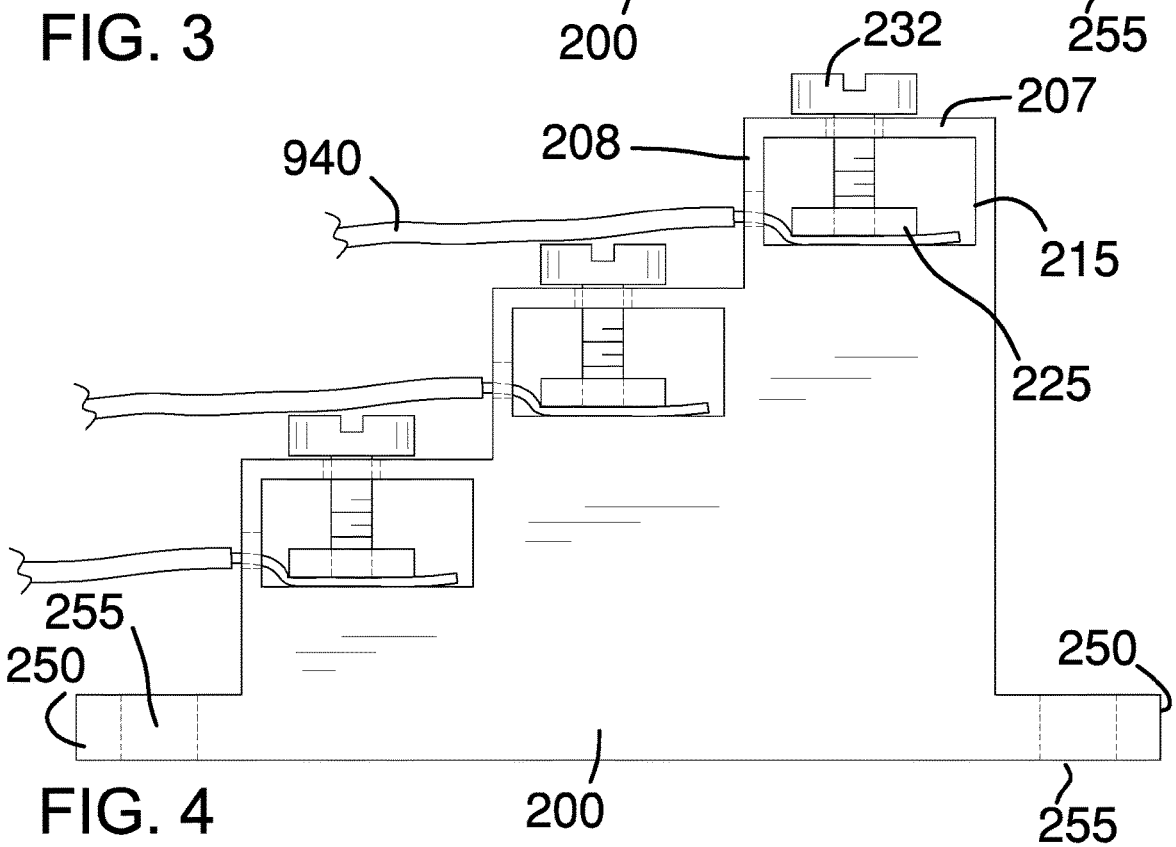
FIG. 4 is a side view of an embodiment of the disclosure while in use and with screw covers removed.
Figure 5:
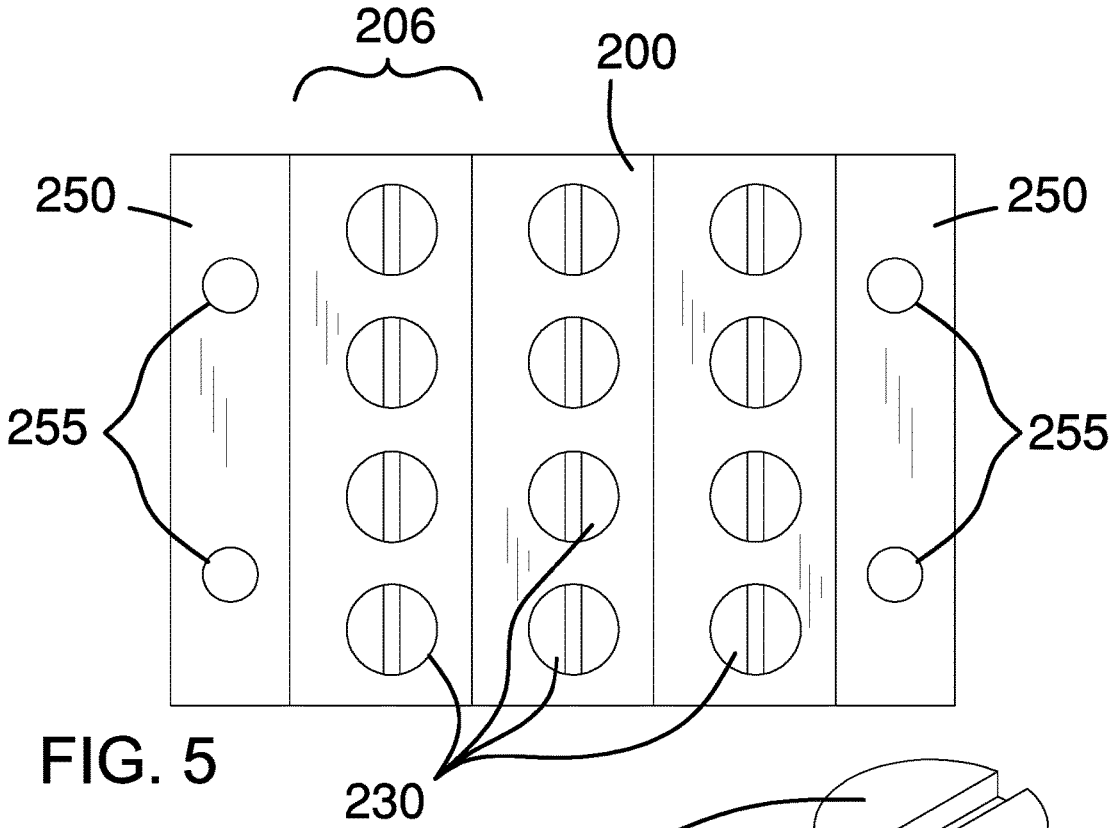
FIG. 5 is a top view of an embodiment of the disclosure.
Figure 6:
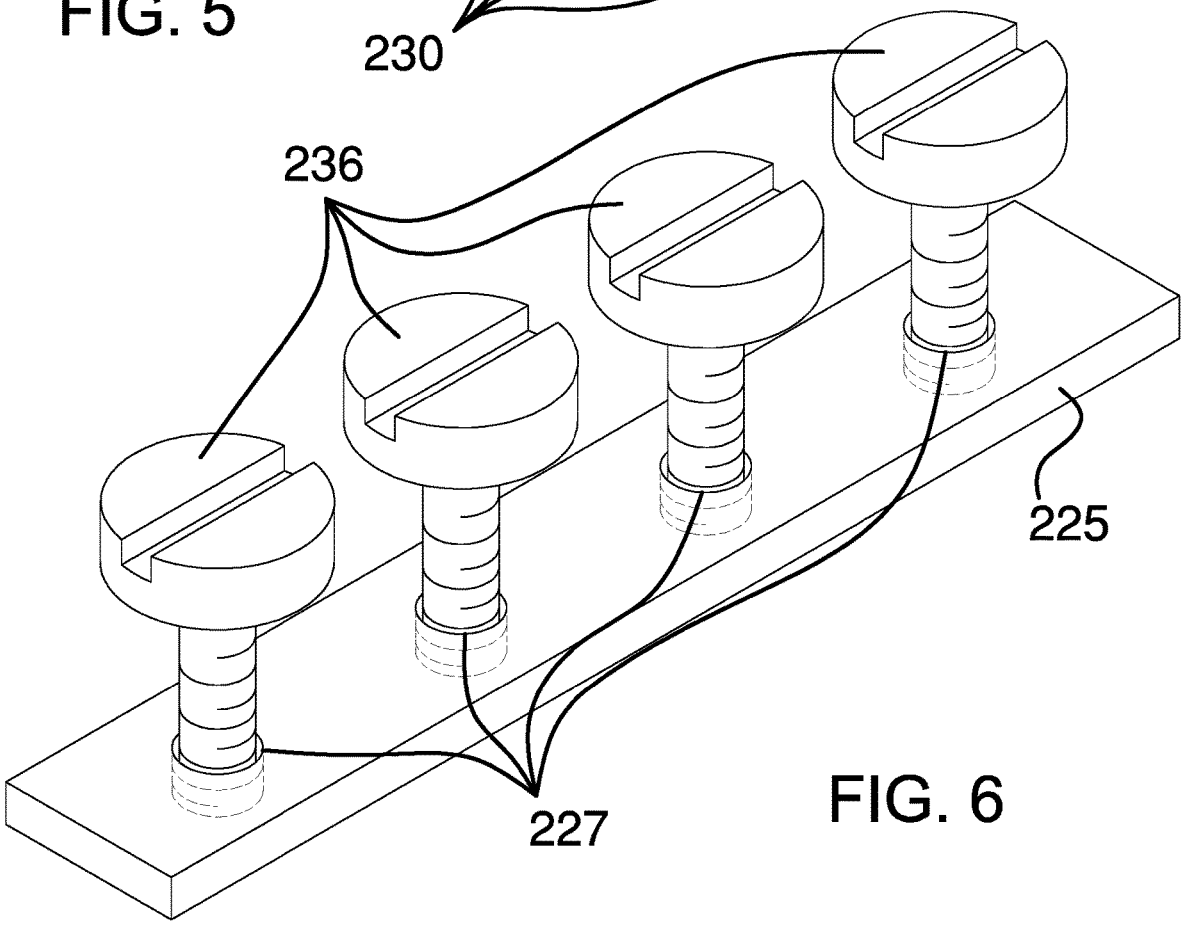
FIG. 6 is a detail view of an embodiment of the disclosure illustrating an individual bar with clamp screws in place.

Detailed reference will now be made to a first potential embodiment of the disclosure, which is illustrated in FIGS. 1 through 6.

The electrical wiring junction box 100 (hereinafter invention) comprises an insulated base 200, a plurality of wiring apertures 240, a plurality of bar apertures 210, a plurality of conductive bars 220, and a plurality of clamp screws 230. The insulated base 200 may comprise a plurality of tiers 203 at different vertical heights. Each of the plurality of tiers 203 may be associated with an electrical attribute. One of the plurality of bar apertures 210, one of the plurality of conductive bars 220, a subset of the clamp screws 236, and a subset of the wiring apertures 244 are associated with an individual tier 206 selected from the plurality of tiers 203. A first conductor 941 of a first circuit may be electrically coupled to a second conductor 942 of a second circuit via an individual bar 225 of the individual tier 206 by connecting the first conductor 941 to the individual bar 225 and by connecting the second conductor 942 to the individual bar 225. An individual conductor 940 may be connected to the individual bar 225 by placing the stripped end of the individual conductor 940 into an individual wiring aperture 242 selected from the plurality of wiring apertures 240 and then tightening an individual clamp screw 232 at the individual wiring aperture 242 where the individual conductor 940 is inserted.

As non-limiting examples, the electrical attribute may be a frequency, an amplitude, a phase, or combinations thereof.

The insulated base 200 may be a non-conducting support for the plurality of conductive bars 220 and the plurality of clamp screws 230. The insulated base 200 may have a substantially flat bottom and a stepped top. The steps of the top may define the plurality of tiers 203. The individual tier 206 selected from the plurality of tiers 203 may comprise a top tier face 207 and a front tier face 208. The plurality of bar apertures 210 may pass laterally through the insulated base 200. An individual bar aperture 215 may be adjacent to and below the top tier face 207 of the individual tier 206 and adjacent to and behind the front tier face 208 of the individual tier 206.

In some embodiments, there may be two, three, or four of the individual tiers 206. As a non-limiting example, for the insulated base 200 where the plurality of tiers 203 number two, the individual tiers 206 may correspond to the "hot" potential (black wire) and to the "neutral" potential (white or gray wire). As a further non-limiting example, for the insulated base 200 where the plurality of tiers 203 number three, the individual tiers 206 may correspond to the "hot" potential (black wire), to the "neutral" potential (white or gray wire), and to "ground" potential (bare or green wire). As a further non-limiting example, for the insulated base 200 where the plurality of tiers 203 number four, the individual tiers 206 may correspond to the "hot" potential (black wire), to the "neutral" potential (white or gray wire), to a "secondary hot" potential (red wire), and to "ground" potential (bare or green wire).

The top tier face 207 may comprise a plurality of screw apertures 234. The plurality of clamp screws 230 may pass through the top tier face 207 from the top of the insulated base 200 at each of the plurality of screw apertures 234. The front tier face 208 may comprise the plurality of wiring apertures 240. The plurality of wiring apertures 240 may provide access for a plurality of conductors to pass through the front tier face 208 from the front of the insulated base 200 at each of the plurality of wiring apertures 240. There may be a one-to-one correspondence between the plurality of wiring apertures 240 and the plurality of clamp screws 230 such that the individual clamp screw 232 may be used to clamp the individual conductor 940 inserted through the individual wiring aperture 242 that corresponds to the individual clamp screw 232.

The plurality of conductive bars 220 may be conductive armatures that pass laterally through the insulated base 200 via the plurality of bar apertures 210. The individual bar 225 selected from the plurality of conductive bars 220 may electrically couple the individual conductors 940 that are inserted through the subset of the wiring apertures 244 and clamped by the subset of the clamp screws 236. The plurality of conductive bars 220 may comprise a plurality of bar screw apertures 227 that run laterally across the plurality of conductive bars 220 at a position and spacing that matches the locations of the plurality of screw apertures 234 in the top tier face 207 above each of the individual bars 225.

In some embodiments, the plurality of conductive bars 220 may be made of copper, aluminum, steel, or combinations thereof.

The plurality of clamp screws 230 may be used to clamp the individual conductors 940 such that the individual conductors 940 are mechanically retained in the insulated base 200 and are electrically coupled to one of the plurality of conductive bars 220. The plurality of clamp screws 230 may be electrically conductive. The individual clamp screw 232 selected from the plurality of clamp screws 230 may be threaded with a thread that complements the thread of the plurality of screw apertures 234 and the thread of the plurality of bar screw apertures 227. The individual clamp screw 232 may be threaded into one of the plurality of screw apertures 234 and into one of the plurality of bar screw apertures 227. A gap 238 may be provided under the individual bar 225, between the bottom of the individual bar 225 and the insulated base 200 such that the individual conductor 940 inserted into the individual wiring aperture 242 may slide into the gap 238. The individual clamp screw 232 may be screwed in to closed the gap 238 beneath the individual bar 225, thus pinching the individual conductor 940 between the insulated base 200 and the individual clamp screw 232. The individual clamp screw 232 may be unscrewed to open the gap 238 beneath the individual bar 225, thus releasing the individual conductor 940 that is located under the individual bar 225. The individual clamp screw 232 may make electrical contact with the stripped end of the individual conductor 940 when the individual clamp screw 232 is screwed in and pinching the individual conductor 940. The individual clamp screw 232 may make electrical contact with the individual bar 225. The individual clamp screw 232 may therefore electrically couple the individual conductor 940 to other conductors that are electrically coupled to the individual bar 225.

The insulated base 200 may comprise a plurality of mounting tabs 250. The plurality of mounting tabs 250 may be horizontal extensions of the bottom of the insulated base 200 that are used to hold the insulated base 200 in a junction box. Each of the plurality of mounting tabs 250 may comprise one or more mounting holes 255. The one or more mounting holes 255 may allow a mounting screw to fasten the plurality of mounting tabs 250 to the junction box.

The invention 100 may further comprise one or more screw covers 280. The one or more screw covers 280 may be non-conducting clips that snap onto the insulated base 200 to block access to the plurality of clamp screws 230. An individual screw cover 289 may be a semi-rigid, C-shaped clip comprising a horizontal shield 281, a left vertical shield 282, a right vertical shield 283, a left latch wing 284, and a right latch wing 285. The left latch wing 284 and the right latch wing 285 may slide into opposite ends of the individual bar aperture 215 to hold the individual screw cover 289 in place. The individual screw cover 289 may be removed by flexing the individual screw cover 289 to release the left latch wing 284, the right latch wing 285, or both and then sliding the one or more screw covers 280 off of the insulated base 200.

In use, the insulated base 200 is mounted within the junction box using the plurality of mounting tabs 250 and the one or more mounting holes 255. The plurality of conductors from the first circuit may be coupled to the invention 100 by stripping the end of each of the individual conductors 940, backing the individual clamp screws 232 out, sliding the stripped end of the individual conductors 940 into the individual wiring apertures 242, and tightening the individual clamp screws 232 down. The plurality of conductors from the first circuit may be similarly coupled to the invention 100. The first circuit and the second circuit are coupled to the invention 100 such that the individual conductors 940 are assigned to the individual tiers 206 according to the color of the insulator on the individual conductor 940 to prevent mixing the electrical attributes. As a non-limiting example, if the insulated base 200 has three tiers a black wire representing "hot" or "live" potential of the first circuit may be coupled to a top tier 290 where it is electrically coupled to the black wire of the second circuit. A white wire representing "neutral" potential of the first circuit may be coupled to a middle tier 293 where it is electrically coupled to the white wire of the second circuit. A green or bare wire representing "ground" potential of the first circuit may be coupled to a bottom tier 296 where it is electrically coupled to the green or bare wire of the second circuit. The one or more screw covers 280 may then be coupled to the insulated base 200 to cover the plurality of clamp screws 230.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "aperture" is an opening in a surface. Aperture may be synonymous with hole, slit, crack, gap, slot, or opening.

As used in this disclosure, the word "correspond" indicates that a first object is in some manner linked to a second object in a one to one relationship or that one or more properties shared by two or more objects match, agree, or align within acceptable manufacturing tolerances.

As used herein, the words "couple", "couples", "coupled" or "coupling", refer to connecting, either directly or indirectly, and does not necessarily imply a mechanical connection.

As used herein, "front" indicates the side of an object that is closest to a forward direction of travel under normal use of the object or the side or part of an object that normally presents itself to view or that is normally used first. "Rear" or "back" refers to the side that is opposite the front.

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, the word "lateral" refers to the sides of an object or movement towards a side. Lateral directions are generally perpendicular to longitudinal directions. "Laterally" refers to movement in a lateral direction.

As used in this disclosure, "resilient" or "semi-rigid" refer to an object or material which will deform when a force is applied to it and which will return to its original shape when the deforming force is removed.

As used herein, the word "substantially" indicates that two or more attributes are the same except for a margin of error related to variances in materials, manufacturing processes, craftsmanship, installation, environmental conditions, or other factors that may influence the attributes and that the differences introduced by these factors are not considered detrimental to the operation of the invention as described herein.

As used in this disclosure, "vertical" refers to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An electrical wiring junction box comprising:

an insulated base, a plurality of wiring apertures, a plurality of bar apertures, a plurality of conductive bars, and a plurality of clamp screws;

wherein the insulated base comprises a plurality of tiers at different vertical heights;

wherein each of the plurality of tiers are associated with an electrical attribute;

wherein one of the plurality of bar apertures, one of the plurality of conductive bars, a subset of the clamp screws, and a subset of the wiring apertures are associated with an individual tier selected from the plurality of tiers;

wherein a first conductor of a first circuit is electrically coupled to a second conductor of a second circuit via an individual bar of the individual tier by connecting the first conductor to the individual bar and by connecting the second conductor to the individual bar;

wherein an individual conductor is connected to the individual bar by placing the stripped end of the individual conductor into an individual wiring aperture selected from the plurality of wiring apertures and then tightening an individual clamp screw at the individual wiring aperture where the individual conductor is inserted.

2. The electrical wiring junction box according to claim 1 wherein the electrical attribute is a frequency, an amplitude, a phase, or combinations thereof.

3. The electrical wiring junction box according to claim 1 wherein the insulated base is a non-conducting support for the plurality of conductive bars and the plurality of clamp screws;

wherein the insulated base has a substantially flat bottom and a stepped top;

wherein the steps of the top define the plurality of tiers.

4. The electrical wiring junction box according to claim 3 wherein the individual tier selected from the plurality of tiers comprises a top tier face and a front tier face;

wherein the plurality of bar apertures pass laterally through the insulated base;

wherein an individual bar aperture is adjacent to and below the top tier face of the individual tier and adjacent to and behind the front tier face of the individual tier.

5. The electrical wiring junction box according to claim 4 wherein there are two, three, or four of the individual tiers.

6. The electrical wiring junction box according to claim 4 wherein the top tier face comprises a plurality of screw apertures;

wherein the plurality of clamp screws pass through the top tier face from the top of the insulated base at each of the plurality of screw apertures.

7. The electrical wiring junction box according to claim 6 wherein the front tier face comprises the plurality of wiring apertures;

wherein the plurality of wiring apertures provide access for a plurality of conductors to pass through the front tier face from the front of the insulated base at each of the plurality of wiring apertures.

8. The electrical wiring junction box according to claim 7 wherein there is a one-to-one correspondence between the plurality of wiring apertures and the plurality of clamp screws such that the individual clamp screw is used to clamp the individual conductor inserted through the individual wiring aperture that corresponds to the individual clamp screw.

9. The electrical wiring junction box according to claim 8 wherein the plurality of conductive bars are conductive armatures that pass laterally through the insulated base via the plurality of bar apertures;

wherein the individual bar selected from the plurality of conductive bars electrically couples the individual conductors that are inserted through the subset of the wiring apertures and clamped by the subset of the clamp screws.

10. The electrical wiring junction box according to claim 9 wherein the plurality of conductive bars comprise a plurality of bar screw apertures that run laterally across the plurality of conductive bars at a position and spacing that matches the locations of the plurality of screw apertures in the top tier face above each of the individual bars.

11. The electrical wiring junction box according to claim 10 wherein the plurality of conductive bars are made of copper, aluminum, steel, or combinations thereof.

12. The electrical wiring junction box according to claim 10 wherein the plurality of clamp screws are used to clamp the individual conductors such that the individual conductors are mechanically retained in the insulated base and are electrically coupled to one of the plurality of conductive bars;

wherein the plurality of clamp screws are electrically conductive.

13. The electrical wiring junction box according to claim 12 wherein the individual clamp screw selected from the plurality of clamp screws is threaded with a thread that complements the thread of the plurality of screw apertures and complements the thread of the plurality of bar screw apertures;

wherein the individual clamp screw is threaded into one of the plurality of screw apertures and into one of the plurality of bar screw apertures.

14. The electrical wiring junction box according to claim 13 wherein a gap is provided under the individual bar, between the bottom of the individual bar and the insulated base such that the individual conductor inserted into the individual wiring aperture slides into the gap.

15. The electrical wiring junction box according to claim 14 wherein the individual clamp screw is screwed in to closed the gap beneath the individual bar, thus pinching the individual conductor between the insulated base and the individual clamp screw;

wherein the individual clamp screw is unscrewed to open the gap beneath the individual bar, thus releasing the individual conductor that is located under the individual bar.

16. The electrical wiring junction box according to claim 15 wherein the individual clamp screw makes electrical contact with the stripped end of the individual conductor when the individual clamp screw is screwed in and pinching the individual conductor;

wherein the individual clamp screw makes electrical contact with the individual bar;

wherein the individual clamp screw therefore electrically couples the individual conductor to other conductors that are electrically coupled to the individual bar.

17. The electrical wiring junction box according to claim 16 wherein the insulated base comprises a plurality of mounting tabs;

wherein the plurality of mounting tabs are horizontal extensions of the bottom of the insulated base that are used to hold the insulated base in a junction box.

18. The electrical wiring junction box according to claim 17 wherein each of the plurality of mounting tabs comprise one or more mounting holes;

wherein the one or more mounting holes allow a mounting screw to fasten the plurality of mounting tabs to the junction box.

19. The electrical wiring junction box according to claim 18 wherein the electrical wiring junction box further comprises one or more screw covers;

wherein the one or more screw covers are non-conducting clips that snap onto the insulated base to block access to the plurality of clamp screws;

wherein an individual screw cover is a semi-rigid, C-shaped clip comprising a horizontal shield, a left vertical shield, a right vertical shield, a left latch wing, and a right latch wing;

wherein the left latch wing and the right latch wing slide into opposite ends of the individual bar aperture to hold the individual screw cover in place;

wherein the individual screw cover is removed by flexing the individual screw cover to release the left latch wing, the right latch wing, or both and then sliding the one or more screw covers off of the insulated base.

* * * * *